United States Patent [19]

Kiyohara

[11] Patent Number: 4,729,557

[45] Date of Patent: Mar. 8, 1988

[54] SHEET FEED DEVICE

[75] Inventor: Takehiko Kiyohara, Zama, Japan

[73] Assignee: Canon Kabushiki Kaisha, Tokyo, Japan

[21] Appl. No.: 68,793

[22] Filed: Jul. 2, 1987

Related U.S. Application Data

[63] Continuation of Ser. No. 798,314, Nov. 15, 1985, abandoned.

[30] Foreign Application Priority Data

Nov. 19, 1984 [JP] Japan ..... 59-244041
Nov. 19, 1984 [JP] Japan ..... 59-244042
Nov. 19, 1984 [JP] Japan ..... 59-244045

[51] Int. Cl.[4] ..... B65H 5/04

[52] U.S. Cl. ..... 271/272; 271/3; 271/314; 271/900; 271/264; 400/644; 400/641; 400/634; 400/645.5

[58] Field of Search ..... 271/272–275, 271/264, 314, 900, 307, 312, 313, 3, 4, 6, 7; 400/642, 644, 646, 647, 647.1, 661.3, 645.3, 641, 645.4, 645.5, 645

[56] References Cited

U.S. PATENT DOCUMENTS 1,569,052 1/1926 Waldheim ..... 400/641 X
1,851,049 3/1932 Lear ..... 400/645.3
1,988,189 1/1935 Dobson ..... 400/647
3,955,889 5/1976 Ishiguro et al. ..... 271/900
4,039,065 8/1977 Seki et al. ..... 197/1 R
4,197,023 4/1980 De Boo et al. ..... 400/647
4,237,466 12/1980 Scranton ..... 400/644
4,421,428 12/1983 Noda et al. ..... 400/120

FOREIGN PATENT DOCUMENTS 0958832 3/1950 France ..... 271/900

OTHER PUBLICATIONS

"Print Ribbon Stripper", Chenoweth, R. D. et al., IBM Technical Disclosure Bulletin, vol. 13, No. 8, Jan. 1971, p. 2235.

*Primary Examiner*—Joseph J. Rolla
*Assistant Examiner*—David H. Bollinger
*Attorney, Agent, or Firm*—Fitzpatrick, Cella, Harper & Scinto

[57] ABSTRACT

A sheet feed device applicable to a recorder such as an ink jet printer or a thermal printer has feed rollers mounted on the same shaft in a spaced relationship and platen blocks mounted in spaces between the feed rollers. A sheet fed along the feed rollers is conveyed to the platen blocks by a feed force of the feed rollers.

23 Claims, 14 Drawing Figures

SHEET FEED DEVICE

This application is a continuation of application Ser. No. 798,314 filed Nov. 15, 1985, now abandoned.

BACKGROUND OF THE INVENTION

1. Field of the Invention

The present invention relates to a sheet feed device applicable to a recorder such as an ink jet printer, a thermal printer or a facsimile machine. The sheet may include a record sheet or a thin plastic sheet on which an image is recorded, and also a document sheet which bears information to be recorded.

2. Description of the Prior Art

In a recorder such as a printer or facsimile machine, platen means which backs up a sheet for a print head and sheet feed means for feeding sheets at a predetermined pitch are required.

To this end, a platen roller (feed roller) having a circular cross-section has been used. The platen roller functions as both platen means and paper feed means and is simple in structure. However, since the platen roller forms a record plane around the roller, the roller diameter must be large in order to assure a flat record plane. When the roller diameter is small relative to and record width, and high print quality is difficult to attain.

In order to resolve the above problem, the sheet may be fed by two parallelly arranged rollers to form a flat record plane between the two rollers. However, since this arrangement uses two rollers, a large space is required and cost increases result.

SUMMARY OF THE INVENTION

It is an object of the present invention to provide a sheet feed device for precisely feeding a sheet in a desired direction.

It is another object of the present invention to provide a sheet feed device which uses a rotating body such as a roller and easily offers a flat record plane.

It is other object of the present invention to provide a compact and low cost sheet feed device.

DESCRIPTION OF THE PREFERRED EMBODIMENTS

Figure 1:
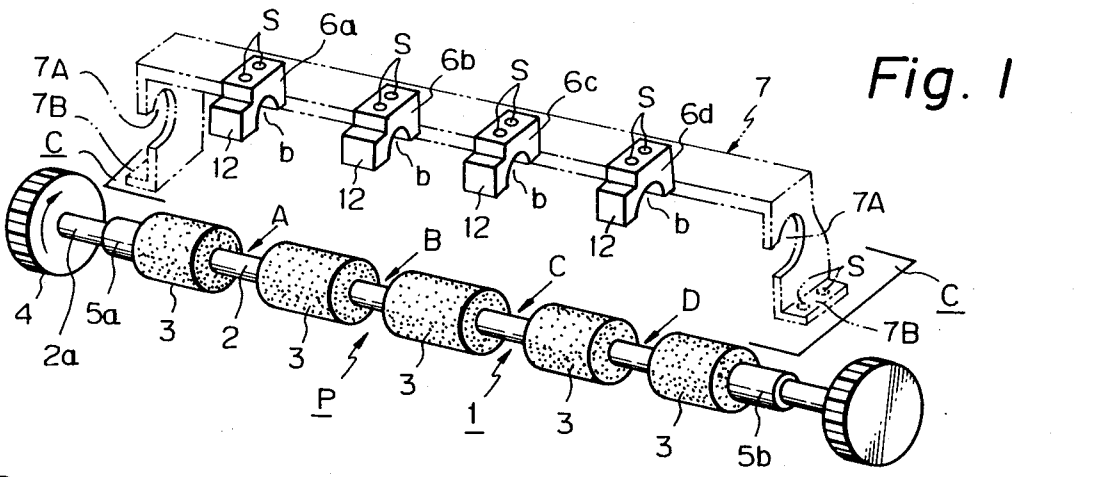
FIG. 1 is a developed perspective view of one embodiment of the present invention.
Figure 3:
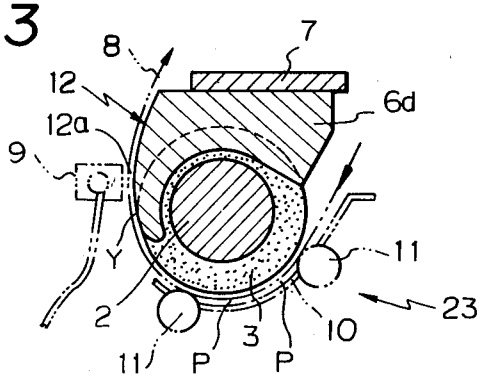
FIG. 3 is a sectional view of a platen block.

FIG. 1 is a developed perspective view of one embodiment of the present invention, FIG. 3 is a sectional view of a feed roller 3 between adjacent platen blocks 6*a* and 6*b*, and FIG. 3 is a sectional view of a platen block 6*d* arranged between adjacent feed rollers 3. In the present embodiment, a sheet feed device 1 for feeding a record sheet 8 to a record area Z is explained. Numeral 3 denotes rollers made of rubber having an appropriate hardness, which are arranged width-wise of a sheet feed path 8. They are mounted on a roller shaft 2 mounted normally to the sheet feed direction, in a spaced relationship to each other. Cylindrical bearing members 5*a* and 5*b* are rotatably mounted on the roller shaft 2 on the outer side of the opposite end rollers 3. A gear 4 is fixed to one end 2*a* of the roller shaft 2.

Figure 2:
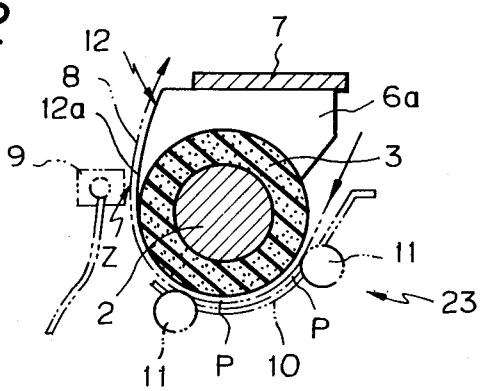
FIG. 2 is a sectional view of a feed roller.

In the present embodiment, the platen blocks 6*a*, 6*b*, 6*c* and 6*d* are arranged such that they are positioned in spaces A, B, C and D between the adjacent rollers 3, respectively. (The block 6*a* is positioned in the space A, the block 6*b* in the space B, the block 6*c* in the space C and the block 6*d* in the space D.) The blocks 6*a*–6*d* have flat or slightly curved guide surfaces 12 at areas facing the sheet feed path P, and notches b to escape from the roller shaft 2. The platen blocks 6*a*–6*d* are fixed to a common bracket 7 by screws S. Grooves 7A formed on the opposite sides of the bracket 7 are fitted to the cylindrical bearing members 5*a* and 5*b*, and projecting areas 7B at the opposite sides of the bracket 7 are fixed to a body C of the device by screws S. Thus, the blocks 6*a*–6*d* are assembled in a predetermined positional relationship without contacting the feed rollers 3, as shown in FIGS. 2 and 3. The blocks 6*a*–6*d* are arranged in the spaces A–D, and portions of peripheries of the blocks 6*a*–6*d* coincide with portions of the peripheries of the rollers 3 with respect to the sheet feed path P. (As shown in FIG. 3 by a symbol Y, the portions of the rollers 3 and the blocks 6*a*–6*d* facing the sheet feed path P coincide with each other.) As descried above, since the guide surfaces 12 of the platen blocks 6*a*–6*d* have flat or slightly curved surfaces continuous to the contact surfaces of the rollers 3, they provide a flat or essentially flat record plane 12*a* at the position of the print head 9 (record area Z). Accordingly, the platen blocks 6*a*–6*d* are positioned on the upper halves of the rollers 3 as shown in FIG. 3 and guide the sheet 8 fed by the feed rollers 3 toward the record area Z (which faces the print head 9) and a downstream area thereof (upward in FIG. 3).

As shown in FIGS. 2 and 3, the present embodiment includes a print head 9 for discharging ink from nozzles (not shown) in accordance with image information to record an image on the sheet 8 fed by the feed rollers 3 in the direction of an arrow, and sheet guide means 23 (shown by double dot chain lines) including a paper pan 10 arranged around the peripheries of the feed rollers 3 and a pair of press rollers 11.

Accordingly, the sheet 8 intermittently fed to the vicinity of the print head 9 in the record area Z by the cooperation of the feed rollers 3 and the sheet guide means 23 along the peripheries of the feed rollers 3 is subsequently guided by the feed force of the feed rollers 3 in the direction of the arrow along the guide surfaces 12 of the platen blocks 6, and it is ejected after the recording by the print head 9.

In accordance with the present embodiment, the flat record plane can be readily obtained by using the flat guide planes 12 of the platen block 6. Thus, the platen structure which also functions to feed the sheet and has the flat record plane is provided with a smaller space and a lower cost than those of the prior art two-roller structure.

Figure 4:
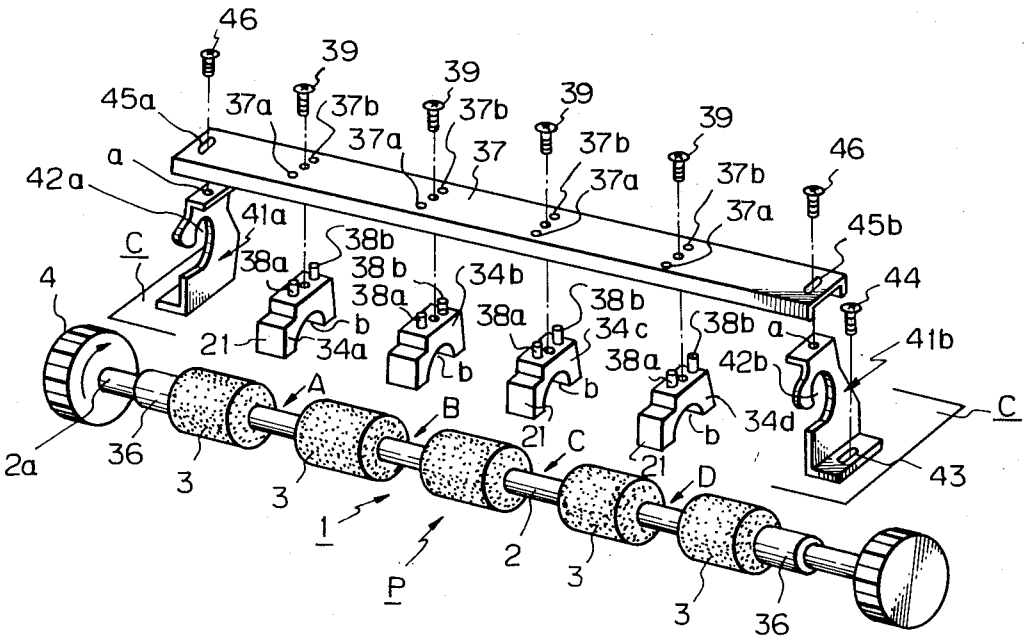
FIG. 4 is a developed perspective view of another embodiment of the present invention.
Figure 5:
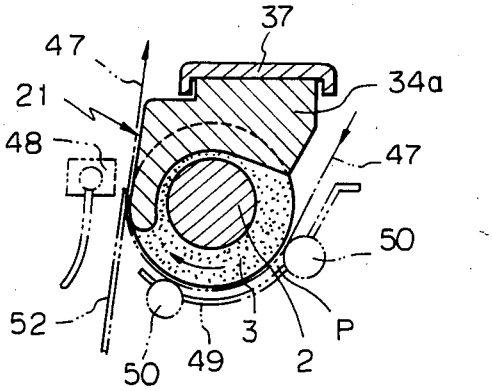
FIG. 5 is a sectional view of a feed roller.
Figure 6:
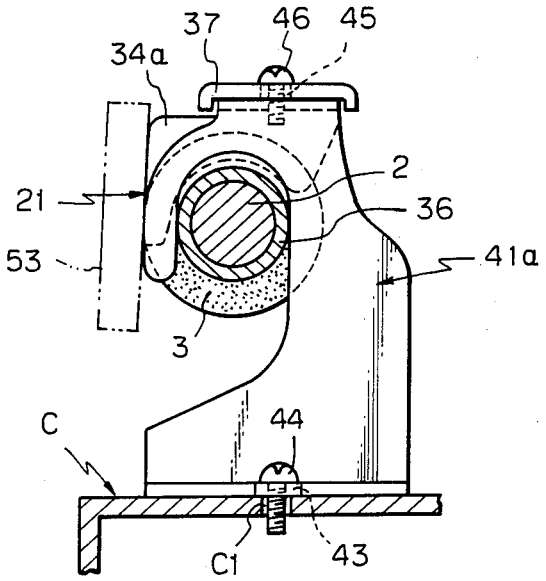
FIG. 6 is a sectional view of a platen block.

FIG. 4 shows a developed perspective view of another embodiment of the present invention, FIG. 5 is a lateral sectional view of a platen block 34*a* and FIG. 6 shows a side view of an assembled structure. The present embodiment comprises a platen holder to which platen blocks are fixed and holder support members for securing the platen holder to a body of the device. The holder support members are engaged to a cylinder member mounted on a roller shaft and the platen holder is longitudinally adjustably mounted on the holder support members so that an accumulated error to the feed rollers is reduced.

Like elements to those shown in the previous embodiment are designated by like numerals.

In the present embodiment, cylindrical members 36 are rotatably and loosely fitted to the opposite ends of the roller shaft 2. Platen blocks 34*a*–34*d* are fixed on a common platen holder 37 in a predetermined spaced relation. In the present embodiment, the platen blocks 34*a*–34*d* are exactly positioned by fitting two fixing pins 38*a* and 38*b* of the platen blocks 34*a*–34*d* to holes 37*a* and 37*b* of the holder 37, and then they are fixed to the platen holder 37 by screws 39.

A guide surface 21 is formed in front of the platen blocks 34*a*–34*d* in order to form a flat record plane in front of a head 48 (FIG. 5) for recording an image on a sheet 47 in accordance with input information and guide the sheet 47 fed by the feed rollers 3 to eject it. The guide surface is flat or slightly curved, and arranged at a right attitude to contact to the periphery of the roller 3 in order to feed the sheet 47 and an exact position to the head 48.

On the other hand, as shown in FIGS. 4 and 6, threaded holes C1 are formed in the body C of the device to fix a pair of holder support members 41*a* and 41*b* which are coupled to the opposite ends of the platen holder 37 to support it. The holder support members 41*a* and 41*b* have threaded holes a at the tops thereof and grooves 42*a* and 42*b* which engage to the surfaces of cylindrical members 36 mounted on the roller shaft 2. They also have slots 43 (which extend toward the feed rollers 3) at the bottoms to couple the members 41*a* and 41*b* to the body C. The holder support members 41*a* and 41*b* are longitudinally positioned by engaging the grooves 42*a* and 42*b* to the cylindrical members 36 as shown in FIG. 6, and are fixed to the body C by screws 44 fitted to the slots 43.

The platen holder 37 (on which the platen blocks 34*a*–34*d* have been mounted) is longitudinally adjustably mounted to the pair of holder support members 41*a* and 41*b* by slots 45*a* and 45*b* (which extend toward the feed rollers 3) and screws 46. The platen holder 37 is then clamped and fixed. Thus, the platen blocks 34*a*–34*d* are positioned at the desired positions between the adjacent rollers 3 so that the portion of the guide surface 21 is coplanar with the peripheries of the rollers 3.

In the present embodiment, in order to record the information on the record sheet 47 fed by the feed rollers 3 in the direction of the arrow, a record head 48 which is normally mounted on a carriage and driven width wise of a platen, guide means including a paper pan 49 arranged around the peripheries of the feed rollers 3 and a pair of press rollers 50, and a leaf spring 52 for pressing the sheet extending along the entire length of the sheet feed path (shown by double dot chain lines) are provided.

In the present embodiment, the platen holder 37 having the platen blocks 34*a*–34*d* positioned and fixed thereto is positioned by the grooves 42*a* and 42*b* and longitudinally adjustably fixed to the holder support members 41*a* and 41*b* fixed to the body C by the slots 45*a* and 45*b* and the screws 46 with adjustable parallellism to the peripheries of the feed rollers 3. Accordingly, the platen blocks 34*a*–34*d* can be exactly and adjustably arranged to the feed rollers 3. Since the holder support members 41*a* and 41*b* are positioned by the cylindrical members 36 which are coaxial with the feed rollers 3, any accumulative error in assembling can be reduced and exact assembling is readily attained.

In assembling the platen blocks 34, the rollers 3 and the platen blocks 34*a*–34*d* are aligned by a gauge block 53 as shown in FIG. 6 while the screws 46 are loosened, and then the screws 46 are tightened. Thus, exact assembling is readily attained. The alignment by the gauge block 53 is preferably carried out at an area to which the edge of the leaf spring 52 of FIG. 5 (extending over the entire length of the sheet feed path P) abuts.

In accordance with the present embodiment, in assembling the platens while also serve to feed the sheet and comprise the spaced feed rollers and the platen blocks arranged between the feed rollers, the platen blocks can be readily and exactly and adjustably mounted relative to the feed rollers.

Figure 7:
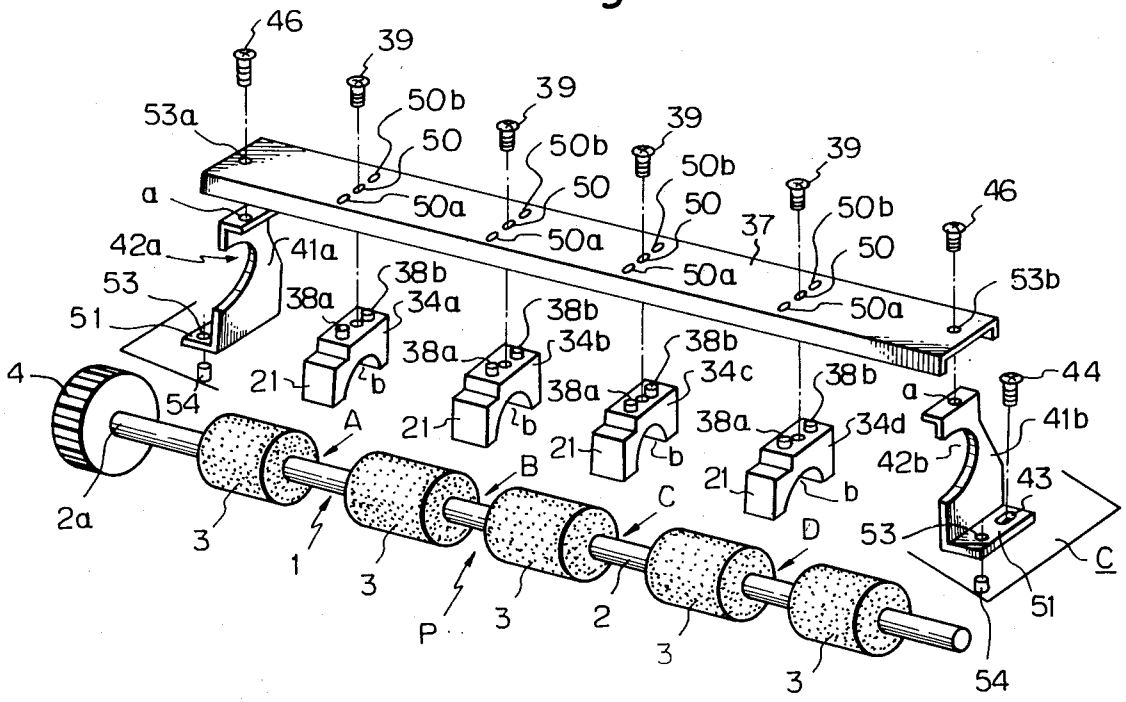
FIG. 7 is a developed perspective view of other embodiment of the present invention.

Another embodiment of the present invention is shown in FIG. 7. In the present embodiment, the platen blocks are mounted on the platen holder such that the guide surfaces of the platen blocks are longitudinally adjustable to the peripheries of the feed rollers, and the platen holder is fixed to the body of the device at a predetermined position.

Figure 8:
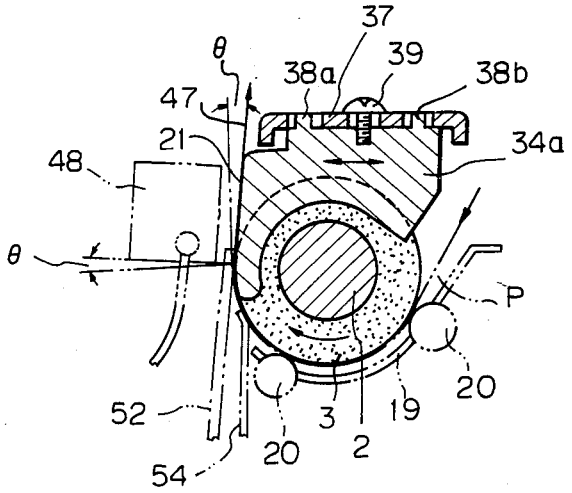
FIG. 8 is a sectional view of a feed roller.
Figure 9:
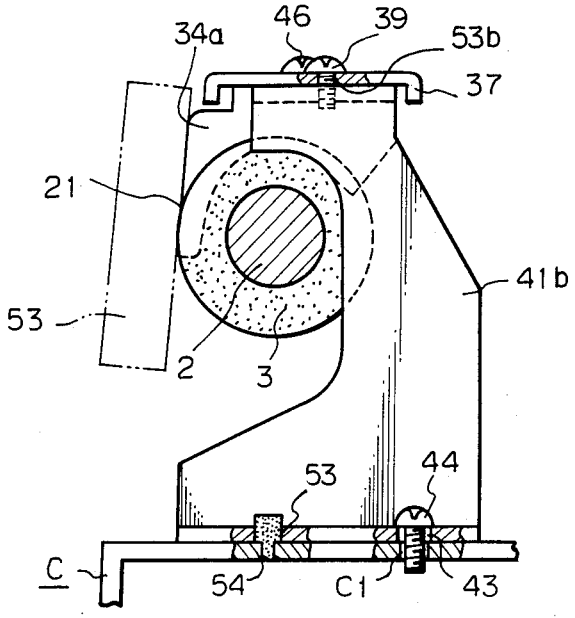
FIG. 9 is a sectional view of a platen block.

FIG. 7 shows a developed perspective view of the present embodiment, FIG. 8 shows a sectional view of the feed roller and FIG. 9 shows a sectional view of the platen block. Like elements to those shown in the previous embodiment are designated by like numerals.

In the present embodiment, holes 50 through which screws 39 are fitted and slots 50*a* and 50*b* (which extend toward the rollers 3) to which positioning pins 38*a* and 38*b* on the tops of the blocks 34*a*–34*d* are fitted are formed in the areas of the platen holder 37 which correspond to the spaces A, B, C and D between the rollers 3. On the other hand, slots 43 to which screws 44 are inserted and holes 53 to which positioning pins 54 of the body C are fitted are formed in the bottom plates 51 of the holder support members 41*a* and 41*b*.

The assembling of the platen blocks 34*a*–34*d*, holder 37 and holder support members 41*a* and 41*b* is explained below.

The mounting of the platen blocks 34*a*–34*d* to the holders 37 is first explained. The platen blocks 34*a*–34*d* are fixed on the common platen holder 37 at a predetermined pitch. In FIG. 7, the pins 38*a* and 38*b* of the platen blocks 34*a*–34*d* are fitted to the slots 50*a* and 50*b* of the holder 37 to exactly position the platen blocks 34*a*–34*d*. Then, they are fixed by the screws 39. Accordingly, the positions of the platen blocks 34*a*–34*d* are adjustable within the range of the slots 50*a* and 50*b*. The holder support members 41a and 41b are longitudinally and laterally positioned by engaging the positioning pins 54 to the holes 50 as shown in FIG. 9, and then fixed to the body C by the screws 44 threaded to the slots 43.

The platen holder 37 (on which the platen blocks 34a–34d have been mounted) is fixed to the pair of holder support members 41a and 41b by the holes 53a and 53b formed at the opposite ends of the platen holder 37 and the screws 46. By fixing the holder 37 to the holder support members 41a and 41b, the platen blocks 34a–34d are positioned between the feed rollers 3 such that the guide surfaces 21 thereof abut against the spring 52. If the position of the block is improper, the screws 37 are loosened to allow adjustment of the position of only that block.

In the present embodiment, the platen holder 37 and the holder support members 41a and 41b are separate, although they may be integral, in which case clamping by the screws 46 is not necessary. In the present embodiment, the leaf spring 54 which weakly presses the peripheries of the rollers 3 is provided upstream (relative to the feed direction of the sheet 47) of the leaf spring 52 which weakly presses the peripheries of the rollers 3 and the guide surfaces 21 of the blocks 34a–34d. As a result, the feed of the sheet 47 is further stabilized. In the present embodiment, the guide surfaces 21 inclines to a tangential line by $\theta°$ (2°–3°), as they do in the other embodiment. As a result, the sheet 47 can more positively maintain contact with the platen blocks 34a–34d and the peripheries of the rollers 3. The record head 48 is also inclined.

In accordance with the present embodiment, the platen blocks 34a–34d are mounted on the platen holder 37 which is fixed to the body C of the device through the holder support members 41a and 41b which are positioned by the positioning pins 54 of the body C and the holes 53 and fixed by the screws 46, such that the parallelism of the guide surfaces 21 of the platen blocks 34a–34d are adjustable to the peripheries of the rollers 3. Accordingly, even if the blocks include dimension errors, the positions of the platen blocks can be individually adjusted so that the platen blocks can be mounted on the holder without accumulated error to the feed rollers 3.

Figure 10:
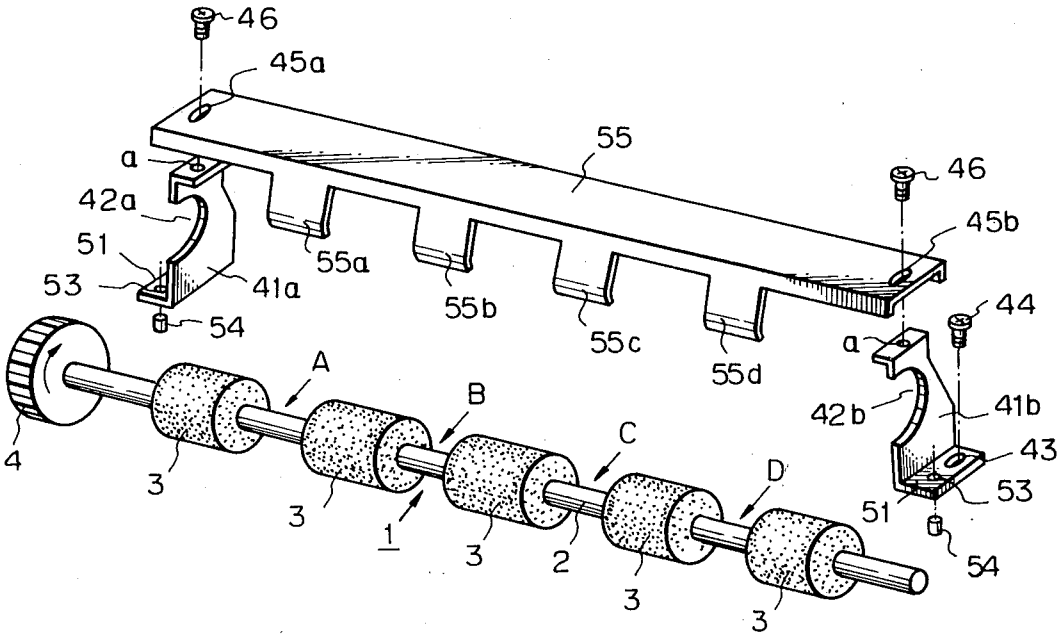
FIG. 10 is a developed perspective view of other embodiment of the present invention.
Figure 11:
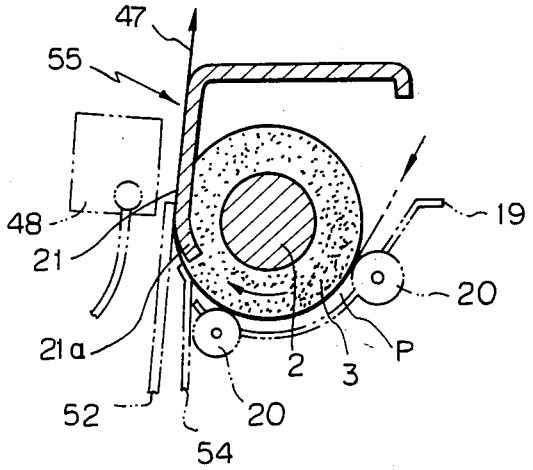
FIG. 11 is a sectional view of a feed roller.

FIGS. 10 and 11 show another embodiment of the present invention. FIG. 10 shows a developed perspective view of the present embodiment and FIG. 11 shows a sectional view of a platen holder. Like elements to those shown in the previous embodiment are designated by like numerals.

In the present embodiment, the platen blocks and the holder are integral. Tongue-shaped guides 55a–55d are formed on the areas of the holder 55 corresponding to the spaces A–D between the adjacent rollers 3. In the present embodiment, the guides 55a–55d can be removed from the body C by removing the screws 46. When they are to be remounted, the holder 55 is positioned along the slots 45a and 45b and the screws 46 are threaded.

Figure 12:
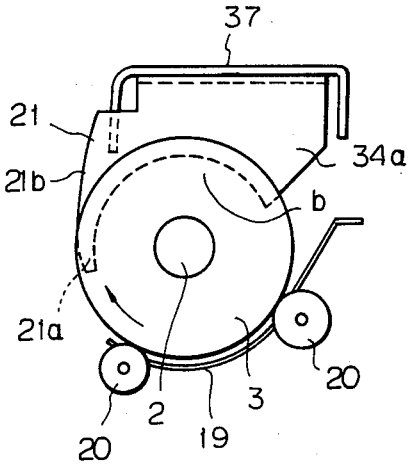
FIG. 12 is a sectional view of a platen block.

FIG. 12 shows a platen block of another embodiment of the present invention. A lower end 21a of the guide surface 21 of the block 34a is inward of the periphery of the roller 3 and has a flat or slightly curved recording plane 21b continuous to the lower end 21a. The sheet (not shown) fed toward the head 48 as the rollers 3 are rotated smoothly rides on the guide surface 21 from the peripheries of the rollers 3. The sheet is positively maintained at the record position in the record area of the record head 48 by the cooperation of the peripheries of the rollers 3 and the guide surfaces 21.

Figure 13:
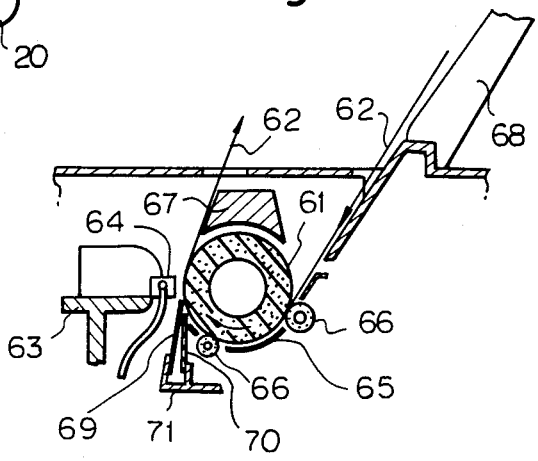
FIG. 13 is a perspective view of other embodiment of the present invention.

FIG. 13 shows another embodiment of the present invention. In the present embodiment, a plurality of stages of leaf springs which press the sheet to the sheet feed rollers near the upstream of the print head are arranged along the sheet feed path.

FIG. 13 shows a sectional view of the recorder of the present invention. The sheet feed roller (platen roller) 61 mounted to the body of the device are driven by a drive source such as a pulse motor in the direction of the arrow to feed the sheet 62 in the direction of the arrow at a predetermined pitch. A carriage 63 which laterally reciprocates along a guide shaft (not shown) parallel to the sheet feed roller is arranged in front of(lefthand in FIG. 13) the sheet feed roller 61, and a print head 64 is mounted on the carriage 63. The print head 64 faces the periphery of the sheet feed roller 61 to define a print area therebetween. A paper pan 65 which forms a predetermined clearance between the periphery of the sheet feed roller 61 and press rollers 66 (two in the present embodiment) releasably pressed to the periphery of the sheet feed roller 61 are arranged upstream of the print head 64 (in the direction of the sheet feed) so that the sheet 62 is guided along the periphery of the sheet feed roller 61. A guide block 67 for guiding the sheet 62 is arranged downstream of the print head 64.

Thus, the sheet 62 is fed from the paper feeder 68 at the top of the device to the contact area of the press roller 66 in the direction of the arrow, and information is printed by the print head 64 while the sheet 62 is guided along the periphery of the sheet feed roller 61, and the sheet 62 is ejected upward through the contact area of the fail roller 62.

As shown in FIG. 13, leaf springs 69 and 70 for pressing the sheet 62 to the periphery of the sheet feed roller 61 are arranged near the upstream of the print head 64 (or print area). The leaf springs 69 and 70 have widths extending over the entire length of the sheet feed roller 61 and are fixed to the body by a bracket 71.

The leaf springs 69 and 70 are arranged such that upper ends thereof align to a base line of the sheet feed roller 61 to press the leading edge of the sheet 2 to the periphery of the sheet feed roller 61 at two points along the sheet feed path.

In accordance with the present embodiment, since the two leaf springs 69 and 70 cooperate to press the sheet 62 at two points over the wide range, the unprinted sheet is guided along the periphery of the sheet feed roller 61 without float or creases so that the sheet feed pitch to the print area is precisely controller. Since the plurality of leaf springs 69 and 70 are used, the press force (spring force) of each spring may be small. Accordingly, a resistance to the thrust of the sheet 62 at the press rollers 66 is low and folding of the edge or creases of the sheet is prevented.

Figure 14:
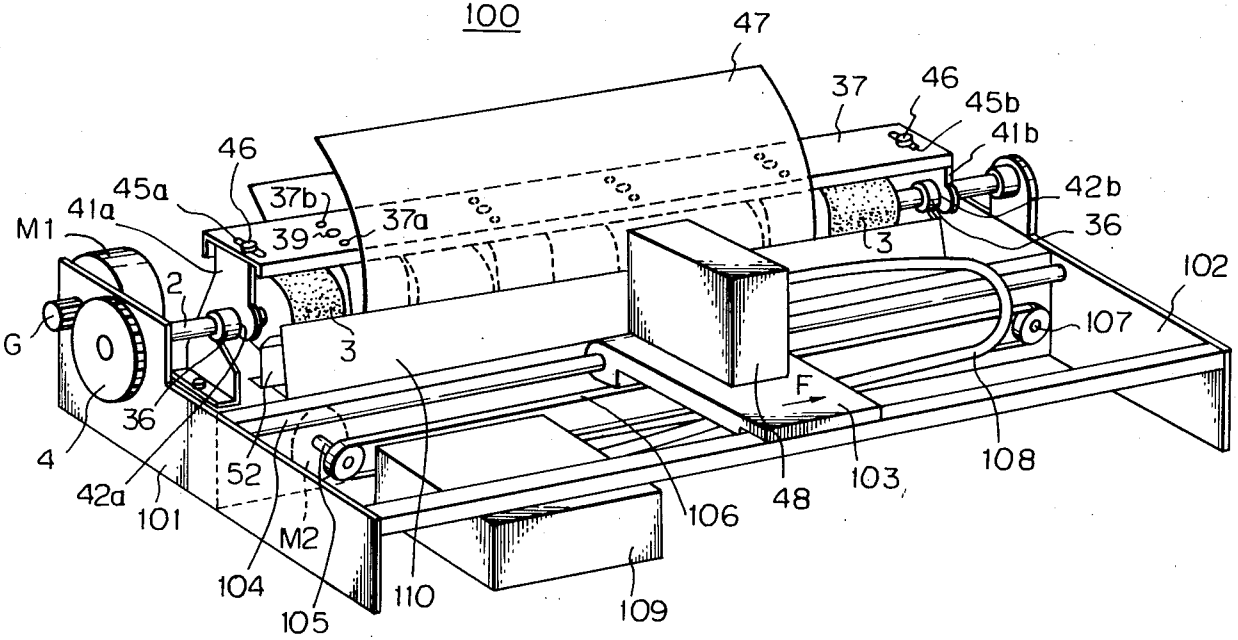
FIG. 14 is a perspective view of an ink jet printer in accordance with one embodiment of the present invention.

An ink jet printer which utilizes the embodiment shown in FIGS. 4–6 is shown in FIG. 14. Numeral 100 denotes an ink jet printer. M1 denotes a roller drive motor, the rotation of which is transmitted to a driven gear 4 fixed to a roller shaft 2 through a drive gear G. As the motor M1 rotates, the feed roller 3 is rotated. The roller shaft 2 is supported by a left end plate 101 and a right end plate 102 through bearings. A recording head 48 is fixed to a carriage 103 which is movable along a guide shaft 104. A rotation of a motor M2 is transmitted to a belt 106 spanned to a belt drive gear 106 fixed to a motor shaft 105. The head 48 is reciprocally moved by the forward and backward movements of the belt 106. Numeral 107 denotes a pulley on which the belt is spanned, numeral 108 denotes an ink tube for supplying ink in an ink container 109 to the head 48, and numeral 110 denotes a leaf spring which abuts against a periphery of the roller 3 upstream of the leaf spring 52.

When a print command is issued to the motor M2, the belt 106 starts to move and the carriage 103 starts to move in the print direction (arrow F). Control signals are applied to nozzles of the head 48 in accordance with characters to be printed so that desired characters are printed on the sheet 47. After printing of one line of characters, a control signal is applied to the motor M1 to rotate the feed roller 3 so that the sheet 47 is fed by a predetermined amount while keeping a stable record width. The above operation is repeated to print all desired characters on the sheet 47. The present embodiment is not limited to the character printing but it may be applied to print picture or graphics.

In a specific example, the roller 3 is made of urethane rubber and has a diameter of approximately 36 mm and a width of approximately 58 mm, the blocks **34*a*–34*d* each has a guide surface width of approximately 28 mm and a length of approximately 26 mm, and a spacing between the roller 3 and the blocks 34*a*–34*d*** is approximately 1–2 mm. Thus, a record width of more than 3 mm is attained and a high quality of image is formed.

In the above embodiment, the leaf springs 52 and 54 extend over the entire width of the sheet feed path, although they may be comb-shaped or they may even omitted. The rotating member is not limited to the roller but it may be a belt spanned on pulleys. A single wide rotating body having portions thereof intermittently taken away may be used.

As described hereinabove, the present invention provides a sheet feed device which enables high quality image formation.

What is claimed is:

1. A sheet feed device for a recording apparatus, comprising:

a plurality of rotatable members arranged in spaced relation along a width of a sheet feed path for feeding a sheet in a feeding direction; and a plurality of guide members separated and disposed between said rotatable members, each said guide member having first and second guide surfaces for guiding the sheet, wherein each said first guide surface is disposed to substantially coincide with a predetermined extent of the peripheries of said rotatable members with respect to the sheet feed path and each said second guide surface extends continuously from the corresponding said first guide surface downstream of said first guide surface with respect to the sheet feeding direction to provide a recording area where the recording apparatus can record on the sheet supported by said second guide surfaces.

2. A device according to claim 1, wherein said guide members are displaceable relative to a support member supporting said guide members.

3. A device according to claim 1, wherein a support member supporting said guide members is displaceable.

4. A device according to claim 1, wherein a portion of each said guide member upstream of said first guide surface thereof with respect to the sheet feeding direction is disposed inwardly of the peripheries of said rotatable members with respect to the sheet feed path.

5. A device according to claim 1, wherein each said second guide surface is flat.

6. A device according to claim 1, wherein each said second guide surface is slightly curved.

7. A sheet feed device for a recording apparatus, comprising:

a plurality of rotatable members arranged in spaced relation along a width of a sheet feed path for feeding a sheet in a feeding direction;

a plurality of guide members separated and disposed between said rotatable members, each said guide member having first and second guide surfaces for guiding the sheet, wherein each said first guide surface is disposed to substantially coincide with a predetermined extent of the peripheries of said rotatable members with respect to the sheet feed path and each said second guide surface extends continuously from the corresponding said first guide surface downstream of first guide surface with respect to the sheet feeding direction to provide a recording area where the recording apparatus can record on the sheet supported by said second guide surfaces; and resilient means opposed to the peripheries of said rotatable members and said first guide surfaces for urging the sheet against the peripheries of said rotating members and said first guide surfaces.

8. A device according to claim 7, wherein said guide members are displaceable relative to a support member supporting said guide members.

9. A device according to claim 7, wherein a support member supporting said guide members is displaceable.

10. A device according to claim 7, wherein said resilient means extends the width of the sheet feed path.

11. A device according to claim 7, wherein said resilient means is arranged at two points, upstream and downstream of said first guide surfaces with respect to the sheet feeding direction.

12. A device according to claim 7, wherein a portion of each said guide member upstream of said first guide surface thereof with respect to the sheet feeding direction is disposed inwardly of the peripheries of said rotatable members with respect to the sheet feed path.

13. A device according to claim 7, wherein each said second guide surface is flat.

14. A device according to claim 7, wherein each said second guide surface is slightly curved.

15. A sheet feed device for a recording apparatus, comprising:

a plurality of rotatable members arranged in a spaced relation along a width of a sheet feed path for feeding a sheet in a feeding direction;

a plurality of guide members separated and disposed between said rotatable members, each said guide member having first and second guide surfaces for guiding the sheet, wherein each said first guide surface is disposed to substantially coincide with a predetermined extent of the peripheries of said rotatable members with respect to the sheet feed path and each said second guide surface extends continuously from the corresponding said first guide surface downstream of said rotatable members at the position of first guide surface with respect to the sheet feeding direction to provide a recording area where the recording apparatus can record on the sheet supported by said second guide surfaces; and support means displaceably supporting said guide members to enable adjustment of the position of said guide members with respect to said rotatable members.

16. A device according to claim 15, wherein each said second guide surface is flat.

17. A device according to claim 15, wherein each said second guide surface is slightly curved.

18. A device according to claim 15, wherein said guide members are removably mounted on said support means.

19. A device according to claim 15, wherein said guide members are integrally fixed with said support means.

20. A recording apparatus for recording an image on a sheet fed by a sheet feed device, comprising:

a plurality of rotatable members arranged in a spaced relation along the width of a sheet feed path for feeding a sheet in a feeding direction;

a plurality of guide members separated and disposed between said rotatable members, each said guide member having first and second guide surfaces for guiding the sheet, wherein said first guide surface is disposed to substantially coincide with a predetermined extent of the peripheries of said rotatable members with respect to the sheet feed path and each said second guide surface extends continuously from the corresponding said first guide surface downstream of first guide surface with respect to the sheet feeding direction to provide a recording area where the recording apparatus can record on the sheet supported by said second guide surfaces; and recording means for recording an image corresponding to information on the sheet, said recording means being disposed in a facing relation with said second guide surfaces.

21. An apparatus according to claim 20, wherein each said second guide surface is flat.

22. An apparatus according to claim 20, wherein each said second guide surface is slightly curved.

23. An apparatus according to claim 20, wherein said recording means comprises a recording head for ejecting liquid ink.

* * * * *

UNITED STATES PATENT AND TRADEMARK OFFICE

CERTIFICATE OF CORRECTION

PATENT NO. : 4,729,557

DATED : March 8, 1988

INVENTOR(S) : TAKEHIKO KIYOHARA

It is certified that error appears in the above-identified patent and that said Letters Patent is hereby corrected as shown below:

COLUMN 1

Line 27, "and" should be deleted.
Line 28, "and" should be deleted.
Line 42, "other" should read --another--.
Line 55, "other" should read --another--.
Line 59, "other" should read --another--.
Line 63, "other" should read --another--.

COLUMN 2

Line 5, "FIG. 3" should read --FIG. 2--.
Line 41, "descried" should read --described--.

COLUMN 3

Line 38, "and" should read --at--.

COLUMN 4

Line 30, "while" should read --which--.

COLUMN 5

Line 15, "37" should read --39--.
Line 28, "inclines" should read --incline--.

UNITED STATES PATENT AND TRADEMARK OFFICE

CERTIFICATE OF CORRECTION

PATENT NO. : 4,729,557

DATED : March 8, 1988

INVENTOR(S) : TAKEHIKO KIYOHARA

It is certified that error appears in the above-identified patent and that said Letters Patent is hereby corrected as shown below:

COLUMN 6

Line 36, "fail roller 62." should read --feed roller 61.--.
Line 45, "sheet 2" should read --sheet 62--.
Line 53, "controller." should read --controlled.--.

COLUMN 7

Line 1, "106" (second occurrence) should be deleted.
Line 5, "belt" should read --belt 106--.
Line 33, "omitted." should read --be omitted--.

COLUMN 8

Line 21, "first" should read --said first--.
Line 66, "first" should read --said first--.

UNITED STATES PATENT AND TRADEMARK OFFICE

CERTIFICATE OF CORRECTION

PATENT NO. : 4,729,557

DATED : March 8, 1988

INVENTOR(S) : TAKEHIKO KIYOHARA

It is certified that error appears in the above-identified patent and that said Letters Patent is hereby corrected as shown below:

COLUMN 10

Line 7, "first" should read --said first--.

Signed and Sealed this

Twenty-seventh Day of September, 1988

*Attest:*

DONALD J. QUIGG

*Attesting Officer*

*Commissioner of Patents and Trademarks*